United States Patent [19]

Kanayachi

[11] Patent Number: 4,844,369

[45] Date of Patent: Jul. 4, 1989

[54] VOUCHER ISSUING DEVICE AND A METHOD OF AUTOMATICALLY LOADING CONTINUOUS VOUCHER FORMS

[75] Inventor: Kiyoshi Kanayachi, Tokyo, Japan

[73] Assignee: Oki Electric Industry Co., Ltd., Tokyo, Japan

[21] Appl. No.: 234,942

[22] Filed: Aug. 22, 1988

[30] Foreign Application Priority Data

Sep. 1, 1987 [JP] Japan ..... 62-216366

[51] Int. Cl.[4] ..... B65H 19/28; B65H 20/40

[52] U.S. Cl. ..... 242/56 R; 242/57; 242/74; 242/67.2; 242/67.4; 225/98; 270/52.5

[58] Field of Search ..... 242/56 R, 67.1 R, 67.2, 242/67.3 R, 67.4, 74; 83/102, 107; 156/344, 584; 270/52.5; 225/98, 99, 100

[56] References Cited

U.S. PATENT DOCUMENTS

| | | | |
|---|---|---|---|
| 2,904,332 | 9/1959 | Metzner | 270/52.5 X |
| 3,514,094 | 5/1970 | Absler et al. | 270/52.5 |
| 4,099,682 | 7/1978 | Benuska | 242/74 X |
| 4,593,893 | 6/1986 | Suter | 270/52.5 |
| 4,770,361 | 9/1988 | Maeda | 242/57 X |

FOREIGN PATENT DOCUMENTS

| | | | |
|---|---|---|---|
| 0229774 | 10/1986 | Japan | 270/52.5 |

*Primary Examiner*—John M. Jillions

*Attorney, Agent, or Firm*—Wenderoth, Lind & Ponack

[57] ABSTRACT

A predetermined number of receipt slips of a continuous length of voucher forms each having a journal slip and a receipt slip placed one over the other are cut off, and the corresponding journal slips are folded back over the succeeding receipt slips to form the leading end of the continuous voucher forms in a threefold arrangement of slips. Then the continuous voucher forms are conveyed in a first direction to advance the leading end of the same to a slit formed in a winding shaft. The winding shaft is turned through a fixed angle after the leading end of the continuous voucher forms passes through the slit. The continuous voucher forms then are conveyed by a predetermined distance corresponding to the length of the predetermined number of receipt slips in a second direction opposite the first direction. Then, the continuous voucher forms are conveyed again in the first direction to wind the journal slip on the winding shaft and to convey the corresponding receipt slip to a receipt slip delivering unit.

7 Claims, 6 Drawing Sheets

VOUCHER ISSUING DEVICE AND A METHOD OF AUTOMATICALLY LOADING CONTINUOUS VOUCHER FORMS

BACKGROUND OF THE INVENTION

1. Field of the Invention

The present invention relates to a voucher issuing device for use in financial institutions and, more particularly, to a voucher issuing device which uses voucher forms each consisting of a receipt slip to be issued to the customer, and a journal slip to be kept for entry in a journal.

2. Description of the Related Art

A voucher issuing device is disclosed in Japanese Patent Laid-open (Kokai) No. 61-169440.

This known voucher issuing device has a journal slip winding mechanism comprising a winding shaft for winding journal slips, a disk fixed to one end of the winding shaft, a sensor disposed at a fixed position near the circumference of the disk, and swingable guide members for guiding the journal form to the winding shaft.

A slit for receiving the leading end of the journal slip is formed in the winding shaft. Two projections are provided at respective diametrically opposite positions on the circumference of the disk.

In operation, the winding shaft is turned until one of the projections provided on the disk is detected by the sensor to bring the slit of the winding shaft into alignment with a path formed by the two guide members in a closed position. Then, a journal slip is guided along the path to the slit of the winding shaft to insert the leading end of the journal slip in the slit. Then, the guide members are opened to retract the same from the winding shaft, and the winding shaft then is turned several turns to wind up the journal slip on the winding shaft.

This winding mechanism of the conventional voucher issuing device, however, has a drawback that it is difficult to insert the leading end of an unfirm journal slip into the slit of the winding shaft and hence it is possible that the winding shaft will not wind up the journal slip. Such a drawback degrades the reliability of the voucher issuing device.

SUMMARY OF THE INVENTION

Accordingly, it is an object of the present invention to provide a voucher issuing device that is compact and simple in construction and capable of automatically and surely storing slips.

To achieve the object of the invention, the present invention provides a voucher issuing device which uses continuous voucher forms each consisting of a set of a journal slip and a receipt slip which are placed one over the other, the leading journal slips extending beyond the leading receipt slip being folded over the leading receipt slips so that the leading end of the continuous voucher forms has three layered slips, comprising: conveying means for conveying the continuous voucher forms; a winding shaft for winding up the journal slips; a disk attached to one end of the winding shaft and provided with projections on the circumference thereof; two position detecting means for detecting the projections to detect the angular phase of the winding shaft; a receipt slip delivering unit for delivering the receipt slips; and guide means for guiding the leading end of the continuous voucher forms conveyed by the conveying means to the winding shaft.

The continuous voucher forms are conveyed in a first direction after setting the leading end of the continuous voucher forms on the conveying means. The leading end of the voucher form conveyed by the conveying means is guided by the guiding means into a slit formed in the winding shaft. The winding shaft is turned through a fixed angle after the leading end of the continuous voucher forms has been passed through the slit. The continuous voucher forms are conveyed in a second direction opposite the first direction by a predetermined distance, and then the continuous voucher forms are conveyed again in the first direction to wind the leading journal slip on the winding shaft and to convey the leading receipt slip to the receipt slip delivering unit.

The above and other objects, features and advantages of the present invention will become more apparent from the following description taken in conjunction with the accompanying drawings.

DESCRIPTION OF THE PREFERRED EMBODIMENT

Figure 1:
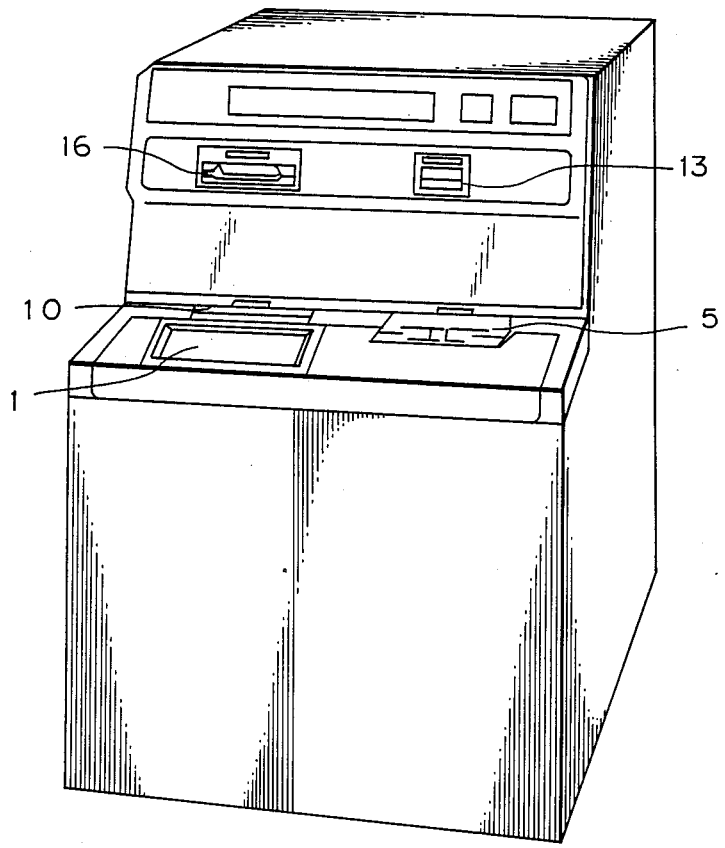
FIG. 1 is a perspective external view of an automatic cash transaction apparatus incorporating a voucher issuing device in a preferred embodiment according to the pesent invention.
Figure 2:
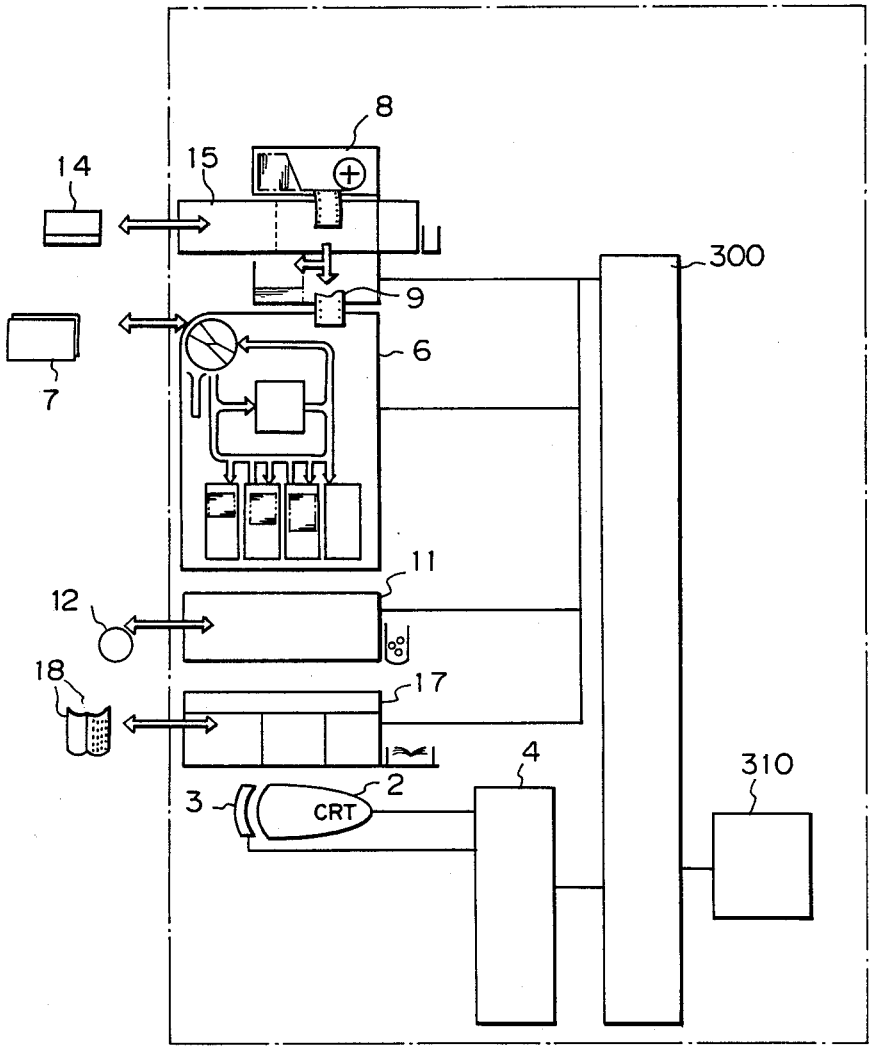
FIG. 2 is a block diagram showing the constitution of the automatic cash transaction apparatus of FIG. 1.

In FIGS. 1 and 2 showing an automatic cash transaction apparatus incorporating a voucher form issuing device in a preferred embodiment according to the present invention, indicated at 1 is a display unit to give instructions to the customer for transaction operation. As shown in FIG. 2, the display unit 1 has a CRT (cathode-ray tube) display 2 and a touch panel 3. The CRT dispaly 2 and the touch panel 3 are controlled by a display control unit 4.

Indicated at 5 is a bank note receiving and delivering unit, and 6 is a bank note receiving and delivering pocket disposed behind the bank note receiving and delivering unit 5. When a bank note or bank notes 7 are placed in the bank note receiving and delivering pocket 5 for deposit transaction, the bank note receiving and delivering unit 6 discriminates and counts the bank notes 7. Then, a voucher form issuing device 8 issues a receipt slip 9 printed with transaction data including the deposit balance and the account code and delivers the receipt slip 9 to the bank note receiving and delivering pocket 5. In the case of payment transaction, bank notes requested by the customer are delivered together with a receipt printed with transaction data to the bank note receiving and delivering pocket 5.

Indicated at 10 is a coin receiving and delivering pocket. A coin receiving and delivering unit 11 is disposed behind the coin receiving and delivering pocket 10. The coin receiving and delivering unit 11 receives or delivers coins of an amount of money specified a deposit transaction or a payment transaction.

Indicated at 13 is a card insertion slot. A card reader 15 for reading information stored in a card 14 is disposed behind the card insertion slot 13. Upon the completion of the transaction, the card reader 15 returns the card 14 to the customer.

Indicated at 16 is a bankbook receptacle. A booking unit 17 for entering transaction data in a bankbook is disposed behind the bank note receptable 16. The booking unit 17 enters transaction data in the bankbook and, upon the completion of the transaction, returns, the bankbook 18 through the bankbook receptacle 16 to the customer.

A main control unit 300 controls the display control unit 4, the bank note receiving and delivering unit 6, the voucher form issuing device 8, the coin receiving and delivering unit 11, the card reader 15 and the booking unit 17. A power supply unit 310 supplies power to those components.

The constitution of the voucher form issuing device 8 will be described hereinafter with reference to FIG. 3.

Figure 3:
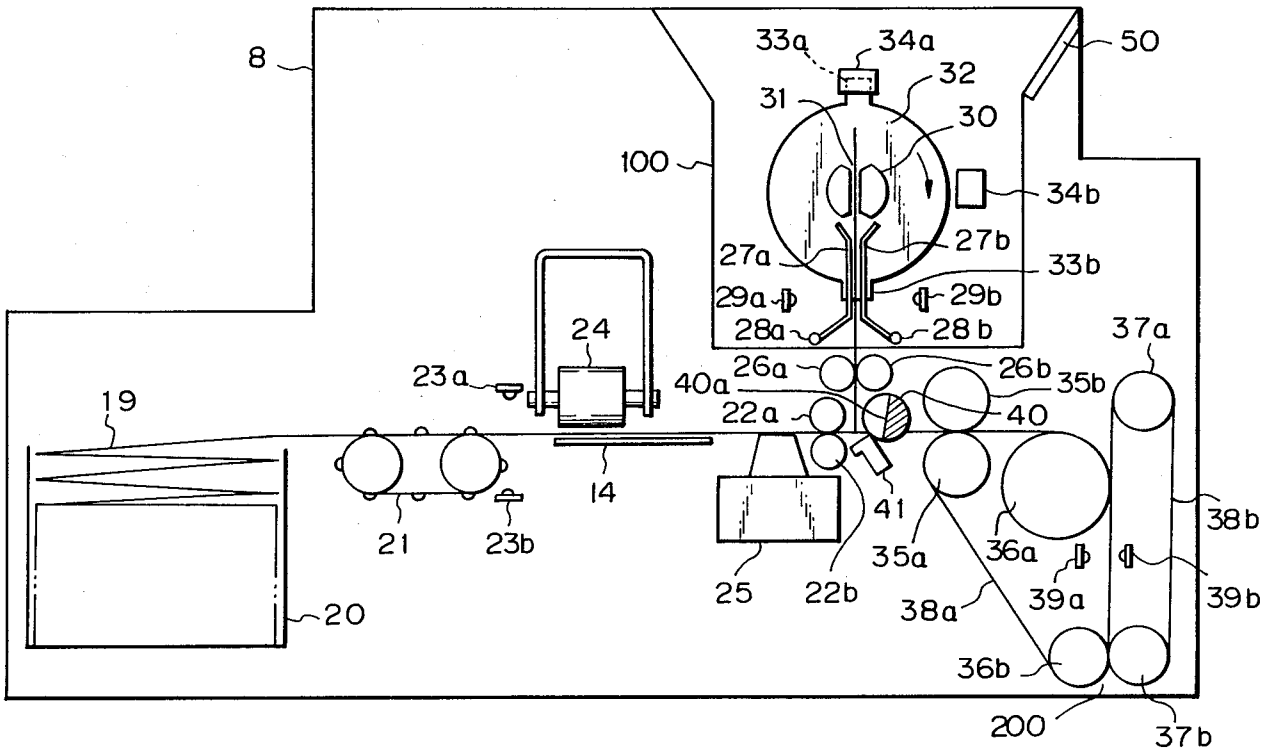
FIG. 3 is a schematic sectional view of the voucher issuing device of FIG. 1.

In FIG. 3, there are shown voucher forms 19, a bin 20 storing the voucher forms 19 A. sprocket belt 21 and a pair of conveyor rollers 22*a* and 22*b* form a first conveyance path. A voucher form detector including a pair of optical sensors 23*a* and 23*b*, an imprinting roller 24 for imprinting letters and numerals embossed on the card 14 on the voucher form 19, and a print head 25 for printing transaction data on the voucher form 19 are arranged sequentially along the first conveyance path. When inserted in the card insertion slot 13, the card 14 is conveyed along a card conveyance path, not shown, extending at right angles to the first conveyance path to a position under the imprint roller 24.

Also shown in FIG. 3 are conveyor rollers 26*a* and 26*b* and a pair of guide members 27*a* and 27*b*, which form a second conveyance path. The sprocket belt 21, the conveyor rollers 22*a* and 22*b* and the conveyor rollers 26*a* and 26*b* are driven by a first driving device, not shown. The guide members 27*a* and 27*b* are swingable away from and toward each other respectively on pivots 28*a* and 28*b*. A pair of optical sensors 29*a* and 29*b* are provided, as voucher form detecting means for detecting the voucher form 19 passing the second conveyance path, on respective opposite sides of the second conveyance path.

A winding shaft 30 provided with a slit 31 is disposed above the second conveyance path. A disk 32 is attached coaxially to one end of the winding shaft 30. Projections 33*a* and 33*b* are formed on the circumference of the disk 32 so as to project radially outward from the circumference at respective diametrically opposite positions. Magnetic sensors 34*a* and 34*b* are disposed near the circumference of the disk 32 at an angular interval of 90°. When the slit 31 of the winding shaft 30 is in alignment with the second conveyance path, either the projection 33*a* or the projection 33*b* is located opposite to the magnetic sensor 34*a*. When the slit 31 is in a position perpendicular to the second conveyance path, either the projection 33*a* or the projection 33*b* is located opposite to the magnetic sensor 34*b*. The guide members 27*a* and 27*b*, the pivots 28*a* and 28*b*, the optical sensors 29*a* and 29*b*, the winding shaft 30, the disk 32, the projections 33*a* and 33*b*, and the magnetic sensors 34*a* and 34*b* are the components of a winding unit 100.

A third conveyance path is formed by conveyor rollers 35*a* and 35*b*, supporting rollers 36*a*, 36*b*, 37*a* and 37*b*, a conveyor belt 38*a* extended around the conveyor roller 35*a* and the supporting rollers 36*a* and 36*b*, and a conveyor belt 38*b* extended around the supporting rollers 37*a* and 37*b*. The conveyor rollers 35*a* and 35*b* are driven by a second driving device, not shown, to turn the conveyor belts 38*a* and 38*b*. A pair of optical sensors 39*a* and 39*b* are provided, as receipt slip detecting means for detecting the passage of a receipt slip 9 along the third conveyance path, near the conveyor belt 38*b*.

A rotary blade 40 and a fixed blade 41 are provided near the conveyor rollers 22*a* and 22*b* to cut a receipt slip 9. A concave or flat guide surface 40*a* is formed in the rotary blade 40. A cut receipt slip 9 is discharged through a discharge opening 200.

A manner of setting the voucher form will be described hereinafter with reference to FIGS. 3 to 7.

Figure 4:
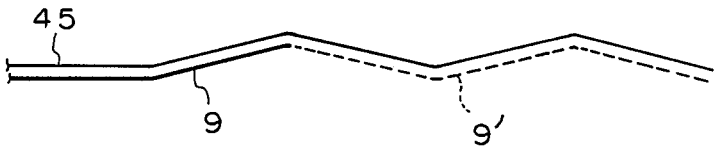
FIG. 4 is an illustration of assistance in explaining the constitution of continuous voucher forms used in the voucher issuing device of FIG. 1.
Figure 5:
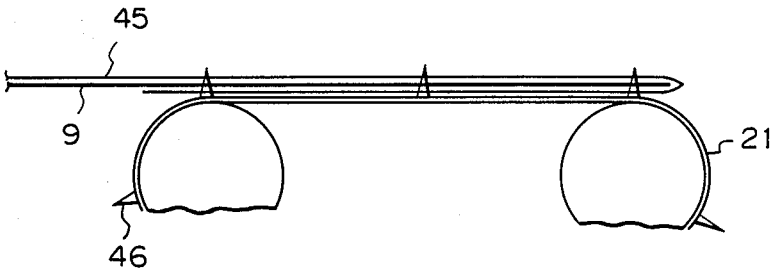
FIG. 5 is an illustration showing continuous voucher forms having a threefold leading end, placed on a sprocket belt.

First, continuous folded voucher forms 19 stored in the bin 20 are pulled out by hand from the bin 20, and then a predetermined number of continuous receipt slips 9' indicated by broken lines in FIG. 4 of the leading voucher forms are torn off. The product of the length of the receipt slip 9' and the number of the receipt slips 9' torn off must be not less than the distance between the position of the conveyor rollers 22*a* and 22*b* and a position corresponding to the edge of the slit 31 of the winding shaft 30 as measured along the first and second conveyance paths (FIG. 3).

Then, journal slips 45 extending from the voucher form after tearing off the receipt slips 9' of the leading voucher forms are folded back over the following receipt slips 9. Thus, the three slips are arranged in layers at the leading end of the continuous folded voucher form 19. Then, the threefold leading end of the continuous folded voucher forms is placed on the sprocket belt 21 so as to be stuck with pins 46 to set the leading end of the continuous folded voucher forms 19 on the first conveyance path.

Then, a switch button, not shown, is pressed to close the guide members 27*a* and 27*b* and, if neither the projection 33*a* nor the projection 33*b* of the disk 32 is detected by the magnetic sensor 34*a*, the winding shaft 30 is turned until either the projection 33*a* or the projection 33*b* is detected by the magnetic sensor 34*a* by a third driving device, not shown. Consequently, the slit 31 is brought into alignment with the second conveyance path formed by the closed guide members 27*a* and 27*b*.

Figure 7A:
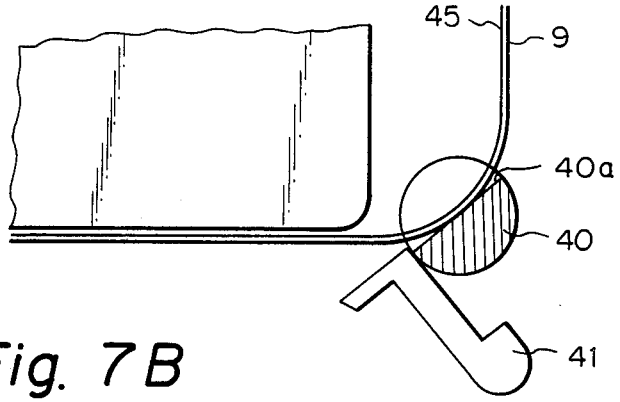
FIG. 7A is a diagrammatic view showing a manner of guiding continuous voucher forms to the winding shaft by the guide surface of a rotary blade.

At the same time, the rotary blade 40 is turned by a fourth driving device, not shown, to a position where the guide surface 40*a* is placed in a position shown in FIG. 7A.

Then, the sprocket belt 21, the conveyor rollers 22*a*, 22*b*, 26*a* and 26*b* are rotated in the normal direction, namely, in a direction to draw out the continuous folded voucher forms 19 from the bin 20, by the first driving device. After passing the conveyor rollers 22*a* and 22*b*, the leading end of the continuous folded voucher forms 19 is guided by the guide surface 40*a* of the rotary blade 40 and the conveyor rollers 26*a* and 26*b* (FIG. 7A).

Then, the conveyor rollers 26*a* and 26*b* inserted the leading end of the continuous folded vouchers 19 in the gap between the guide members 27*a* and 27*b* and advance the continuous folded vouchers 19 toward the winding shaft 30. Eventually, the leading end of the continuous folded voucher forms 19 is inserted in the slit 31 of the winding shaft 30. Since the three slips are arranged in layers in the leading end of the continuous folded voucher forms 19, the leading end passes without fail through the slit 31 of the winding shaft 30. That is, although it is difficult to pass a single journal slip 45, which ordinarily is unfirm, through the slit 31, the threefold leading end of the continuous folded voucher forms 19 is comparatively firm, and hence the leading end can easily be passed through the slit 31.

Upon the passage of the leading end of the continuous folded voucher forms 19 through the slit 31, the sprocket belt 21, and the conveyor rollers 22*a*, 22*b*, 26*a* and 26*b* are stopped to stop feeding the voucher forms 19. The complete passage of the leading end of the continuous folded voucher forms 19 through the slit 31 is detected by the optical sensors 29*a* and 29*b*. The continuous folded voucher forms 19 is stopped after being conveyed by a predetermined distance or for a predetermined time from a moment when the optical sensors 29*a* and 29*b* detect the leading end of the continuous folded voucher forms 19.

Figure 6A:
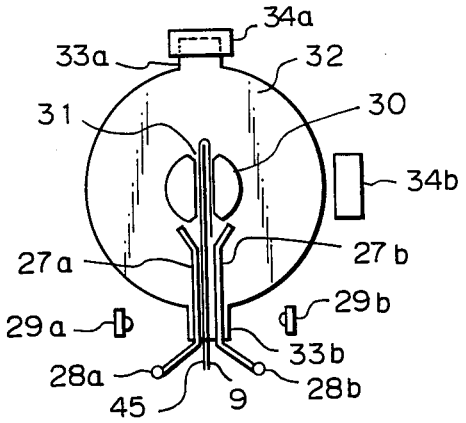
FIG. 6A is a sectional view of a winding shaft, in which the threefold leading end of the continuous voucher form is inserted in a slit formed in the winding shaft.
Figure 6B:
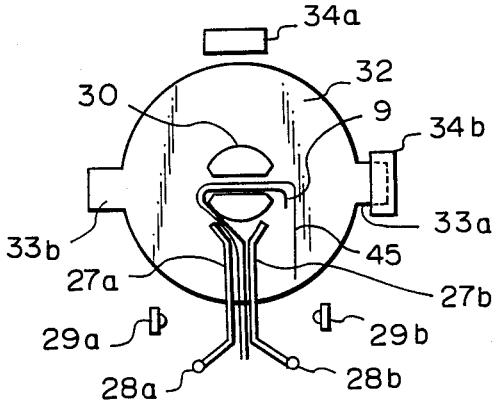
FIG. 6B is s sectional view similar to FIG. 6A, in which the winding shaft has been turned through a fixed angle from a position shown in FIG. 6A.

The disk 32 attached fixedly to the winding shaft 30 is turned in the direction of an arrow shown in FIG. 3 by the third driving device, and is stopped upon the detection of the projection 33*a* by the magnetic sensor 34*b*. In this state, the slit 31 is placed in a position perpendicular to the second conveying path fromed by the guide members 27*a* and 27*b*, and hence the journal slips 45 folded back over the receipt slips 9 in the leading end of the continuous folded voucher forms 19 separate from the receipt slips 9 and are caused to hang down from the winding shaft 30 by their own weight (FIG. 6B).

Then, the first driving device drives the sprocket belt 21 and the conveyor rollers 22*a*, 22*b*, 26*a* and 26*b* in the reverse direction to reverse the continuous folded voucher forms 19 and, upon the arrival of the leading edge of the leading receipt slip 9 at the conveyor rollers 22*a* and 22*b*, the continuous folded voucher forms 19 are stoped. In this state, the leading journal slip 45 remains in the slit 31 and is held on the winding shaft 30.

Figure 6C:
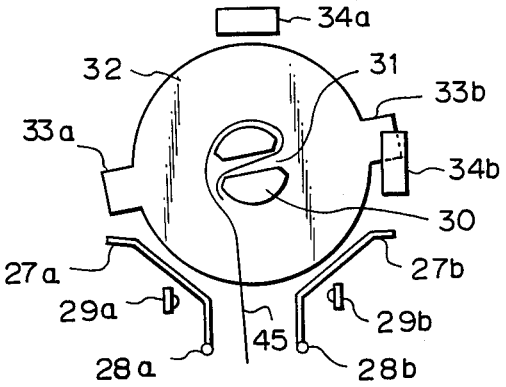
FIG. 6C is a sectional view similar to FIG. 6A, in which a journal slip is being wound on the winding shaft.
Figure 7B:
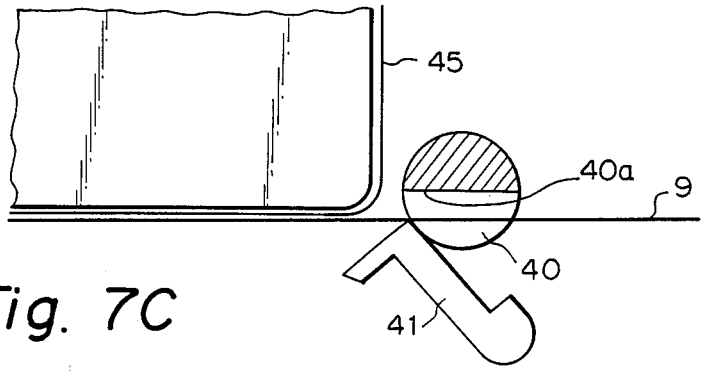
FIG. 7B is a view similar to FIG. 7A, in which the guide surface of the rotary blade is in a horizontal position to allow the receipt slip of the voucher form to pass by the rotary blade.
Figure 7C:
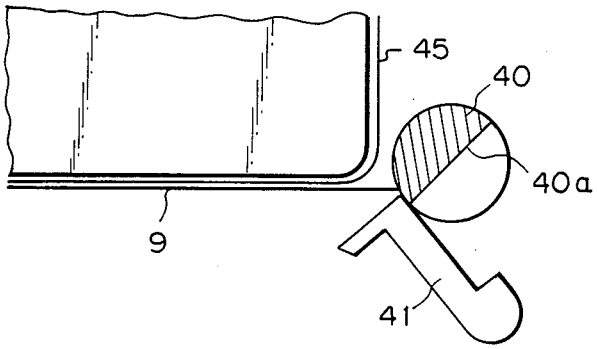
FIG. 7C is a view similar to FIG. 7A, in which the receipt slip of the voucher form is cut off.

Then, the fourth driving device turns the rotary blade 40 to a position where the guide surface 40*a* of the rotary blade 40 is placed in a horizontal position to form a gap between the guide surface 40*a* and the fixed blade 41 as shown in FIG. 7B. Then, the first driving device, the third driving device and the fourth driving device are actuated synchronously to drive the sprocket belt 21 and the conveyor rollers 22*a*, 22*b*, 26*a* and 26*b* in the normal direction, to turn the winding shaft 30 in the normal direction and to drive the conveyor rollers 35*a* and 35*b* to turn the conveyor belts 38*a* and 38*b*. Consequently, the continuous folded voucher forms 19 are drawn out from the bin 20 and the journal slip 45 is wound on the winding shaft 30. While the journal slip 45 is being wound on the winding shaft 30, the guide members 27*a* and 27*b* are turned respectively on the pivots 28*a* and 28*b* away from each other to respective positions outside the disk 32 as shown in FIG. 6C.

On the other hand, the leading receipt slip 9 is conveyed through the gap between the rotary blade 40 and the fixed blade 41 by the conveyor rollers 35*a* and 35*b*, and is inserted between the conveyor belts 38*a* and 38*b*. Upon the detection of the leading edge of the leading receipt slip 9 by the optical sensors 39*a* and 39*b*, the sprocket belt 21, the conveyor rollers 22*a*, 22*b*, 26*a* and 26*b*, the winding shaft 30 and the conveyor rollers 35*a* and 35*b* are stopped, and then the rotary blade 40 is turned to cut off the leading receipt slip 9. Then, the conveyor belts 38*a* and 38*b* are actuated to dicharge the receipt slip 9 through the discharge opening 200 into a receptacle, not shown.

When the automatic cash transaction apparatus is operated for a transaction, the embossed letters and numerals formed on the card 14 are printed by the imprinting roller 24 on the voucher form 19, and transaction data is printed on the same voucher from 19 by the print head 25 as the voucher form 19 is conveyed. The journal slip 45 of the voucher form 19 is would on the winding shaft 30, while the receipt slip 9 of the voucher form 19 is cut off by the rotary blade 40 and the fixed blade 41, and then the receipt slip 9 is delivered along a conveying path, not shown, to the bank note receiving and delivering unit 6.

The printing operations of the imprinting roller 24 and the print head 25 are controlled on the basis of detection signals provided by the optical sensors 39*a* and 39*b*.

When removing the journal slips 45 wound on the winding shaft 30, the journal slips 45 are removed from the winding shaft 30, and then the removed journal slips are cut off from the continous voucher forms 19 by a cutter 50.

Although the present invention has been described in its preferred form with a certain degree of particularity, the present invention is not limited thereto and many variations and chanages are possible therein. For example, the optical sensors 23*a* and 23*b* provided on the first conveyance path may be used instead of the optical sensors 29*a* and 29*b* provided on the second conveyance path, for controlling the feed of the continuous voucher forms 19. Furthermore, although the journal slips 45 folded back over the receipt slips 9 are separated from the continuous voucher forms 19 by turning the winding shaft 30 in the foregoing embodiment, it is possible to separate the journal slips 45 folded back over the receipt slips 9 by holding the journal slips 45 with a suitable separating member.

What is claimed is:

1. A voucher issuing device comprising:

(a) continuous voucher forms each consisting of a journal slip and a receipt slip placed one over the other, and having a threefold leading end formed by cutting off a predetermined number of leading receipt slips and folding back the corresponding journal slips over the receipt slips of the succeeding voucher forms;

(b) conveying means for conveying the continuous voucher forms;

(c) a journal slip winding unit comprising a winding shaft for winding the journal slips, a disk attached to one end of the winding shaft and provided with projections on the circumference thereof, and two position detectors for detecting the projections to detect the angular phase of the winding shaft;

(d) a receipt slip delivering unit for discharging the receipt slips; and (e) guide means for guiding the leading end of the continuous voucher forms being conveyed by the conveying means to the winding shaft.

2. A voucher issuing device according to claim 1, wherein the journal slip winding unit includes a pair of guide members for guiding the leading end of the continuous voucher forms to the winding shaft, and detecting means for detecting the passage of the leading end of the continuous voucher forms through the guide members.

3. A voucher issuing device according to claim 2, wherein the detecting means comprises a pair of optical sensors.

4. A voucher issuing device according to claim 1, wherein the winding shaft is provided with a diametrical slit.

5. A voucher issuing device according to claim 4, wherein the slit has a size capable of receiving therethrough the threefold leading end of the continuous voucher forms.

6. A voucher issuing device according to claim 1, wherein the guide means is a semicylindrical member having a flat surface, and an edge for cutting the receipt slip.

7. A method of automatically loading a continuous voucher forms in a voucher issuing device, comprising the steps of:

(a) cutting off a predetermined number of leading receipt slips of continuous voucher forms each having a journal slip and a receipt slip placed one over the other, and folding back the corresponding journal slips over the succeeding receipt slips to form the leading end of the continuous voucher-forms in a threefold arrangement of slips;

(b) conveying the voucher forms having the threefold leading end in a first direction;

(c) guiding the leading end of the continuous voucher forms into a slit formed in a winding shaft;

(d) turning the winding shaft through a fixed angle after passing the leading end of the voucher forms through the slit;

(e) conveying the continuous voucher forms by a predetermined distance in a second direction opposite the first direction; and (f) conveying the continuous voucher forms again in the first direction to wind the journal slips on the winding shaft and deliver the leading receipt slip to a receipt slip delivering opening.

* * * * *